US008245526B2

(12) United States Patent
Becker et al.

(10) Patent No.: US 8,245,526 B2
(45) Date of Patent: Aug. 21, 2012

(54) COOLING DEVICE HAVING THREE TEMPERATURE ZONES

(75) Inventors: Wolfgang Becker, Blaustein (DE); Adolf Feinauer, Giengen (DE); Helmut Konopa, Leipheim (DE); Peter Nalbach, Kirchheim/Nabern (DE); Wolfgang Nuiding, Giengen (DE); Berthold Pflomm, Ulm (DE); Simon Schechinger, Heidenheim (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 516 days.

(21) Appl. No.: 12/532,199

(22) PCT Filed: Mar. 19, 2008

(86) PCT No.: PCT/EP2008/053277

§ 371 (c)(1),
(2), (4) Date: Sep. 21, 2009

(87) PCT Pub. No.: WO2008/122493

PCT Pub. Date: Oct. 16, 2008

(65) Prior Publication Data

US 2010/0043476 A1 Feb. 25, 2010

(30) Foreign Application Priority Data

Apr. 10, 2007 (DE) ..... 10 2007 016 849

(51) Int. Cl.
*F25B 7/00* (2006.01)

(52) U.S. Cl. ..... 62/335; 62/441

(58) Field of Classification Search ..... 62/335, 62/199, 441, 447, 204, 179, 222; 165/166, 165/DIG. 71, DIG. 185
See application file for complete search history.

(56) References Cited

U.S. PATENT DOCUMENTS

| | | | |
|---|---|---|---|
| 4,512,162 | A | 4/1985 | Etou et al. |
| 5,477,915 | A | 12/1995 | Park |
| 2005/0081544 | A1 | 4/2005 | Jin |

FOREIGN PATENT DOCUMENTS

| | | | |
|---|---|---|---|
| DE | 1941495 | | 4/1970 |
| DE | 3804863 | A1 | 8/1989 |
| DE | 19756861 | A1 | 6/1999 |
| EP | 0602379 | A2 | 6/1994 |
| JP | 2002-267317 | A | 9/2002 |

OTHER PUBLICATIONS

Report of Examination Ru 2009137098/06.

*Primary Examiner* — Mohammad Ali
(74) *Attorney, Agent, or Firm* — James E. Howard; Andre Pallapies

(57) ABSTRACT

A cooling device is provided having three storage zones that are insulated from each other and cooled via evaporators through which a coolant flows. A first coolant circuit extends through a first and a second of the three storage zones and a second coolant circuit positioned parallel to the first coolant circuit extends through the first and the third of the storage zones.

9 Claims, 1 Drawing Sheet

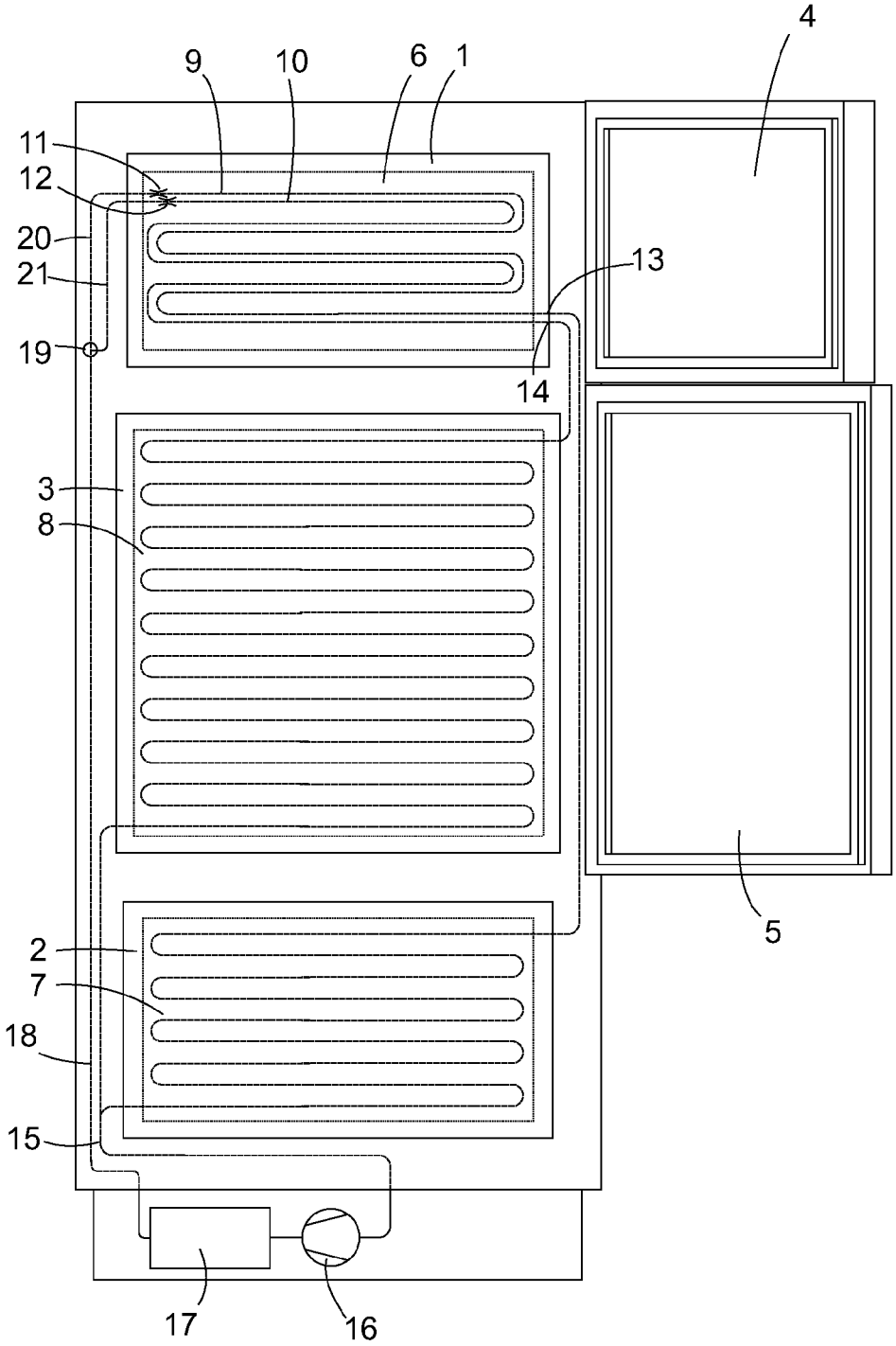
4
9
10
6
1
11
12
20
21
13
19
14
3
8
5
2
7
18
15
17
16

COOLING DEVICE HAVING THREE TEMPERATURE ZONES

BACKGROUND OF THE INVENTION

The present invention relates to a cooling device having three storage zones that are insulated from each other and are cooled by means of evaporators through which a coolant flows.

With a conventional cooling device of this type, the evaporators of the three storage zones are connected one behind the other in a coolant circuit. The cooling power of the evaporator furthest downstream in the coolant circuit is controlled by way of the quantity of coolant circulating in the coolant circuit. To this end, a coolant collector is arranged in a high pressure region of the coolant circuit. If this stores liquid coolant, the coolant circuit operates in an underfilled state, which results in the coolant essentially already being evaporated before it reaches the evaporator which is arranged furthest downstream. The cooling power therefore concentrates on the storage zones cooled by the evaporators arranged further upstream. Since independent control of the cooling power is not possible in the two storage zones upstream, the cooling power of this evaporator and the coolant requirement of these storage zones have to be attuned precisely to one another in order to prevent one or other storage zones from being undercooled.

DE 197 56 861A1 attempts to eliminate this disadvantage by a second injection point being provided on the evaporator arranged furthest upstream in the case of a cooling device having three storage zones, which are cooled by means of evaporators connected in series in a coolant circuit, said second injection point enabling the path of the coolant through this evaporator to be shortened. Even with this arrangement, however, an independent cooling of the two storage zones arranged downstream in the coolant circuit is difficult.

DE-OS 1 941 495 discloses a cooling device having three storage zones, to which evaporators arranged in parallel coolant circuits are assigned in each instance. Such a design also enables an arbitrary distribution of the cooling power onto the different storage zones, but the control valves required herefor result in high costs.

BRIEF SUMMARY OF THE INVENTION

The aim of the present invention is to specify a cooling device having three storage zones, in which the cooling power can be easily flexibly distributed onto the different storage zones.

The object is achieved in that with a cooling device having three storage zones that are insulated from each other, and are cooled by means of evaporators through which a coolant flows, with a first coolant circuit extending through a first and a second of the three storage zones, a second coolant circuit which is parallel to the first coolant circuit extends through the first and the third storage zones.

If coolant circulates through the first coolant circuit in each instance, the available cooling power is distributed onto the first and the second storage zone at a first rate (with this rate being variable by varying the circulating coolant quantity, controlling the developing coolant pressures or suchlike), and if the coolant circulates through the second coolant circuit, the cooling power distributes at a second rate onto the first and third storage zones. If however both coolant circuits are supplied at the same time, the heat dissipating from the first storage zone is distributed onto both coolant circuits—in other words: the coolant of the first circuit is cooled by that of the second circuit and vice versa, so that the distribution of the cooling power in each of the two coolant circuits clearly moves to benefit the second and/or third storage zone.

The first storage zone in both coolant circuits is preferably the storage zone arranged upstream.

The shift in the cooling power distribution which is observed during simultaneous operation of the two coolant circuits is more significant, the lower the temperature difference between the first storage zone and the coolant circulating therein. The first storage zone is therefore preferably the coldest among the three storage zones.

If is also advantageous for the redistribution of the cooling power if the coolant circuit in the first storage zone is guided over an identical plate-type evaporator.

Furthermore, each coolant circuit should preferably extend across essentially the entire extension of the plate-type evaporator of this first storage zone, so that there are no regions on this plate-type evaporator which are essentially only cooled by one of the two coolant circuits.

To control the coolant distribution, it is expedient to arrange a non-return valve upstream of the storage zones in each coolant circuit.

The non-return valve is preferably a magnet valve.

An evaporator for a cooling device of the type cited above is characterized in that it has two separate coolant pipes which do not communicate with one another on a common plate.

An injection point is expediently formed in each of these coolant pipes.

BRIEF DESCRIPTION OF THE DRAWINGS

Further features and advantages of the invention result from the description below of exemplary embodiments with reference to the appended FIGURE.

FIG. 1 shows a schematic representation of an inventive cooling device.

DETAILED DESCRIPTION OF EXEMPLARY EMBODIMENTS OF THE PRESENT INVENTION

FIG. 1 shows a schematic front view of a cooling device having three storage zones, a freezer compartment 1, a cool-fresh refrigerator compartment 2 and a normal refrigerator compartment 3. Rotatable doors 4, 5 which are shown in the open position are assigned to the freezer compartment 1 and the normal refrigerator compartment 3 in each instance. The normal refrigerator compartment 3 is normally sealed by a front plate of a drawer which can be pulled out. The drawer is not shown in the FIGURE so as to be able to indicate the rear walls of all three compartments 1, 2, 3. An evaporator 6, 7, 8 for cooling the corresponding compartment 1, 2, 3 respectively is arranged on these rear walls in each instance, on the foam side and is therefore not visible per se. The evaporators 6, 7, 8 are illustrated as dashed outlines in each instance. They are designed in a manner known per se from a flat plate made of metal, for instance made of aluminum sheet metal, and which rests against the rear wall of the corresponding compartment, and a second metal plate connected in a planar fashion to this plate, in which channels forming refrigerant pipes are recessed, alternatively, the refrigerant pipes can also be formed by pipelines fastened to the plate.

Two refrigerant pipes 9, 10 run on the plate of the freezer compartment 6 in a meandering fashion adjacent to one another from an injection point 11 and/or 12 to an outlet 13 and/or 14. Both refrigerant pipes 9, 10 extend essentially across the whole height and width of the plate so that the overall surface thereof can be efficiently cooled both by the refrigerant pipe 9 and also the refrigerant pipe 10. The evaporator 7 of the cool-fresh refrigerator compartment 2 is connected to the outlet 13; the evaporator 8 of the normal refrigerator compartment 3 is connected to the outlet 14. The evaporators 7, 8 are connected to a compressor 16 by way of a common intake line 15, the compressor 16 supplies the two refrigerant pipes 9, 19 of the refrigerator compartment evaporator 6 by way of an evaporator 17, a pressure line 18, a magnet valve 19 and capillaries 20, 21, which open out into the refrigerant pipes 9 and/or 10 at the injection points 11, 12.

In a first position of the magnet valve 19, this connects the pressure line 18 to the refrigerant pipe 9 of the freezer compartment evaporator 6 and to the evaporator 7 of the cool-fresh compartment 2 which is connected in series therewith, while the pipe 10 is blocked. In this state, the cooling power of the circulating refrigerant is distributed onto the freezer compartment 1 and the cool-fresh compartment 2 at a first rate which is predefined by the structure of the cooling device.

In a second position of the magnet valve 19, the pipe 9 is blocked, while the pipe 10 and the evaporator 8 of the normal refrigerator compartment 3 which is connected in series therewith is supplied. The cooling power of the refrigerant thus distributes at a second rate onto the freezer compartment 1 and the normal refrigerator compartment 3.

In a third position of the magnet valve 19, both coolant pipes 9, 10 of the freezer compartment evaporator 1 and the evaporators 7 and/or 8 connected in series therewith are simultaneously provided with refrigerant. The refrigerant flow through the freezer compartment evaporator 6 is therefore greater than in the two previously mentioned positions of the magnet valve 19, but nevertheless does not result in a significantly greater cooling of the freezer compartment evaporator 6. Therefore in this position, the distribution of the cooling power in each of the two parallel refrigerant circuits moves in favor of the respective compartment 2 or 3 arranged downstream thereof. It is therefore possible to dimension the measurements of the evaporators 6, 7, 8 and the insulation material thicknesses surrounding the compartments 1, 2, 3 such that with an exclusively non-simultaneous operation of the parallel refrigerant circuit, in other words during operation only in the first two positions of the magnet valve 19, a somewhat too intensive a cooling of the freezer compartment 1 results, if the other two compartments 2, 3 are each controlled to a target temperature. This excessive cooling of the freezer compartment 1 can however be prevented by the two parallel refrigerant circuits being supplied at the same time in the third position of the magnet valve 19. In this way the temperatures in the three compartments can be effectively controlled independently of one another without it being necessary herefor to reduce temporarily the quantity of circulating refrigerant and thus to bring about an inefficient underfilled state of the refrigerant circuit.

The invention claimed is:

1. A cooling device comprising:

a plurality of storage zones including a group of three storage zones formed of a first, a second, and a third storage zone each of which is insulated from the other two storage zones and each of which is cooled via a respective evaporator through which a coolant flows;

a first coolant circuit along which a coolant flows extending through the first storage zone and the second storage zone; and a second refrigerant circuit that is substantially co-extensive with the first refrigerant circuit extending through the first storage zone and the third storage zone.

2. The cooling device as claimed in claim 1, wherein the first storage zone is the respective storage zone in each of the first coolant circuit and the second coolant circuit that is upstream of the other storage zone in the coolant circuit.

3. The cooling device as claimed in claim 1, wherein the first storage zone is the coldest among the group of three storage zones.

4. The cooling device as claimed in claim 1, wherein each of the first coolant circuit and the second coolant circuit is guided in the first storage zone via an identical plate-type evaporator.

5. The cooling device as claimed in claim 4, wherein each of the first coolant circuit and the second coolant circuit effectively extends beyond the entire extension of the plate-type evaporator of the evaporator of the first storage zone.

6. The cooling device as claimed in claim 1, wherein each of the first coolant circuit and the second coolant circuit includes a non-return valve arranged upstream of the storage zones in the coolant circuit.

7. The cooling device as claimed in claim 6, wherein the non-return valve is a magnet valve.

8. The cooling device as claimed in claim 2, wherein the respective evaporator for the first storage zone is a plate-type evaporator having a common plate and has two refrigerant pipes that are not connected to one another on the common plate.

9. The evaporator as claimed in claim 8 and further comprising an injection point formed in each of the two refrigerant pipes.

* * * * *